US008708291B2

(12) United States Patent
Christeson

(10) Patent No.: US 8,708,291 B2
(45) Date of Patent: Apr. 29, 2014

(54) PLUMBING FIXTURE SHIM AND SHEET THEREOF

(76) Inventor: Michael E. Christeson, Santa Barbara, CA (US)

( * ) Notice: Subject to any disclaimer, the term of this patent is extended or adjusted under 35 U.S.C. 154(b) by 469 days.

(21) Appl. No.: 12/953,046

(22) Filed: Nov. 23, 2010

(65) Prior Publication Data

US 2012/0126084 A1 May 24, 2012

(51) Int. Cl.
*F16M 11/24* (2006.01)

(52) U.S. Cl.
USPC ..... 248/188.2; 248/49; 248/686

(58) Field of Classification Search
USPC ..... 248/188.2, 49, 65; 52/126.1; 16/247; 254/104
See application file for complete search history.

(56) References Cited

U.S. PATENT DOCUMENTS

| | | | | | |
|---|---|---|---|---|---|
| 4,731,965 | A | * | 3/1988 | Jensen | 52/126.1 |
| 5,853,838 | A | * | 12/1998 | Siems et al. | 428/43 |
| 5,953,862 | A | * | 9/1999 | Earhart et al. | 52/98 |
| 6,062,517 | A | * | 5/2000 | Torres et al. | 248/188.2 |
| 6,155,004 | A | * | 12/2000 | Earhart et al. | 52/98 |
| 6,230,446 | B1 | | 5/2001 | Chalich | |
| 6,581,214 | B1 | | 6/2003 | Love et al. | |
| 7,108,901 | B2 | * | 9/2006 | Traub et al. | 428/43 |
| 7,536,747 | B2 | | 5/2009 | Christeson et al. | |

* cited by examiner

*Primary Examiner* — Steven Marsh
(74) *Attorney, Agent, or Firm* — Edwin Tarver, Esq.; Lauson & Tarver, LLP

(57) ABSTRACT

A shim for placement under plumbing fixtures is made of a series of shim members aligned according to height, whereby they form a wedge-shaped member. The shim is inserted between a plumbing fixture base and installation surface until one of the shim members supports the fixture. The shim members are connected by tabs designed to disengage from the shims on the side facing out from the plumbing fixture in a manner so that when separated, the tabs remain affixed to the portion of the shim removed from under the plumbing fixture. Each shim member also comprises a trough-shaped surface to accommodate curvature on the underside of the plumbing fixture.

5 Claims, 3 Drawing Sheets

PLUMBING FIXTURE SHIM AND SHEET THEREOF

BACKGROUND

Shims are known in the art, as are break-away shims, wherein a shim portion not under load may be separated from the remainder of the shim. U.S. Pat. No. 6,581,214 to Love et al., discloses a spacer and shim assembly for elevating the water closet ring of a toilet bowl. Although this device is capable of insertion between a plumbing fixture and installation surface, it can only be used for toilet assemblies and must be centered directly thereunder in order to function. Also, the only way to achieve varying shim heights is to employ multiple shims.

U.S. Pat. No. 6,230,446 to Chalich discloses a frangible wedge shim for construction. This shim comprises a plastic wedge-shaped shim for leveling which is pre-scored to enable a protruding section to be broken off. Although this device anticipates the portion extending away from the shimmed area to be broken off, the scores in the shim are constructed so that residual pieces of the shim are left behind, obstructing the application of caulk, plaster or grout.

Therefore it is one object of the present invention to provide a shim system for use under plumbing fixtures. Another object of the invention is to provide a shim capable of receiving the convex shape of the bottom of a plumbing fixture, anchoring it into position. Another object of the invention is to provide a plumbing fixture shim that can be broken off at the point of insertion under a plumbing fixture, which leaves a smooth surface that can be covered by plaster, grout or caulk. These and other objects will become apparent through the appended summary, description and claims.

SUMMARY

Plumbing fixtures typically have a convex curved bottom surface, also presenting an arc defined by a curving side to the fixture. When installed, due to height variations in installation surfaces, portions of the fixture's bottom may not engage the installation surface, leading to instability, structural weakness, and a propensity for sealants such as grout or caulk to crack.

The present invention addresses these problems by presenting a plastic, hard polystyrene shim with detachable connected segments. The segments are arced in a nested series, all having the same direction of curvature. The segments have detachable tabs located at the upper portion of the segments, causing them to be spaced apart, the segments arranged from thickest to thinnest, each segment comprising a concave channel designed to engage the bottom of a plumbing fixture. The concave channels extend across the length of each segment.

Because of the channel orientation and detachable tabs, once a segment supporting a plumbing fixture is separated from the remaining segments which are not under the fixture, a smooth surface with no protruding pieces is left under the fixture. Ideally, the invention will be of molded construction, having living hinges to connect detachable segments together. Each segment has a hollow underside to conserve material and reduce weight while allowing the shim segments to support the substantial weight of a plumbing fixture.

DESCRIPTION

Figure 1:
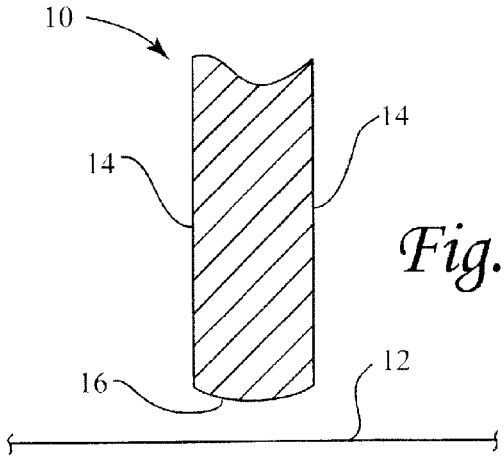
FIG. 1 is a cross section of the bottom of a plumbing fixture.

Referring to FIG. 1, the lower portion of a plumbing fixture 10 is shown in cross section adjacent a surface 12. The fixture 10 has two vertical sides 14 and a convex curved bottom 16. Typically, the bottom 16 will have a face comprising an arc defined by a ⅜ inch radius, although dimensions vary from fixture to fixture. Because of height variations and anomalies in the surface 12, portions of the fixture 10 bottom 16 may not engage the surface 12, leading to instability, structural weakness, and a propensity for the grout or caulk interface between the surface 12 and bottom 16 to crack.

Figure 2A:
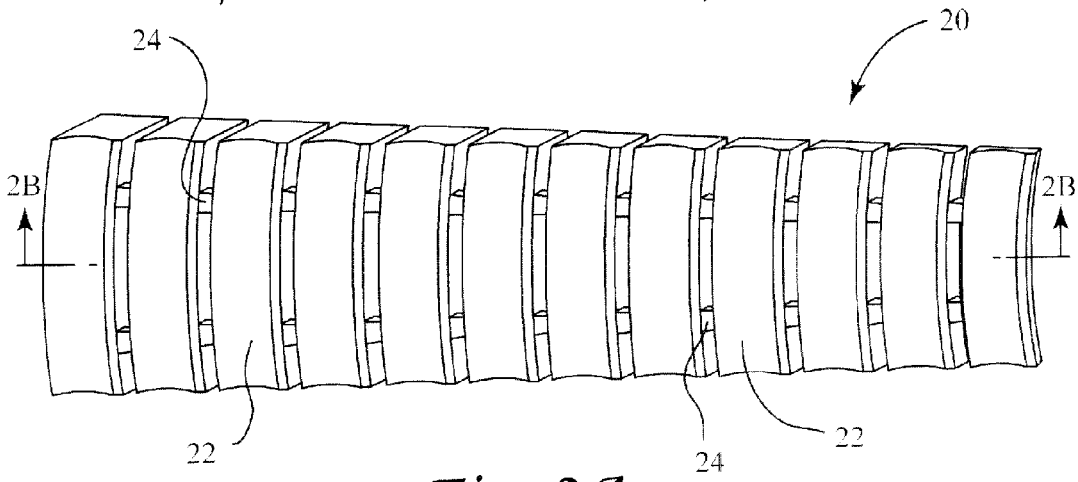
FIG. 2A is a top perspective view of the plumbing fixture shim of the present invention.

Referring to FIG. 2A, the shim 20 of the present invention is shown. The shim 20 is designed to comprise a series of connected segments 22. The segments 22 comprise arced segments in a nested configuration wherein all segments 22 have the same direction of curvature. Ideally, the arcs of the segments are defined by a radius of 4.25 inches, although other radii are contemplated in alternative embodiments of the invention. The segments 22 comprise generally elongated members connected in a series by detachable tabs 24. In a preferred embodiment, the detachable tabs 24 cause the segments 22 to be spaced 0.052 inches apart. The segments 22 are arranged from thickest to thinnest, to create a generally sloping shape. In a preferred embodiment, the segments 22 are connected so that the shim 20 overall has a uniform flat bottom and a gradually sloping top.

Figure 2B:
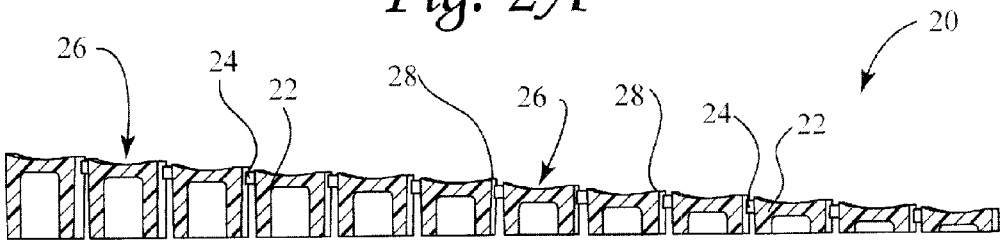
FIG. 2B is a side cut-away view of the plumbing fixture shim of the present invention.

Referring to FIG. 2B, the shim 20 is shown in side view. In this view it can be seen that the detachable tabs 24 are located at the upper portion of the segments 22. Furthermore, each segment 22 comprises a concave channel 26 designed to engage the bottom of a plumbing fixture (as shown in FIG. 1). The concave channels 26 extend from the edge of a segment 22 adjacent the next larger segment 22, to the opposite segment 22 edge adjacent the next smaller segment 22. Because of the changing height of the segments 22, the side of the channel 26, adjacent the next larger segment 22 is higher than the side of the channel 26 adjacent the next smaller segment 22. Because of this difference in height, a flattened area 28 is created on one side of each segment 22. Preferably, the channels comprise an arc with a radius of 0.75 inches. In a further embodiment, the channels have a depth of 0.028 inches Because of the orientation of the channels 26 and since the detachable tabs 24 break away from the smaller support segment 22, the segment 22 supporting a plumbing fixture and all smaller segments 22 are disposed under the fixture once the shim 20 is in place and the remaining segments 22 not under the fixture are removed. Since the segments 22 are in a nested configuration, the arc of each segment 22 is the same.

Figure 3:
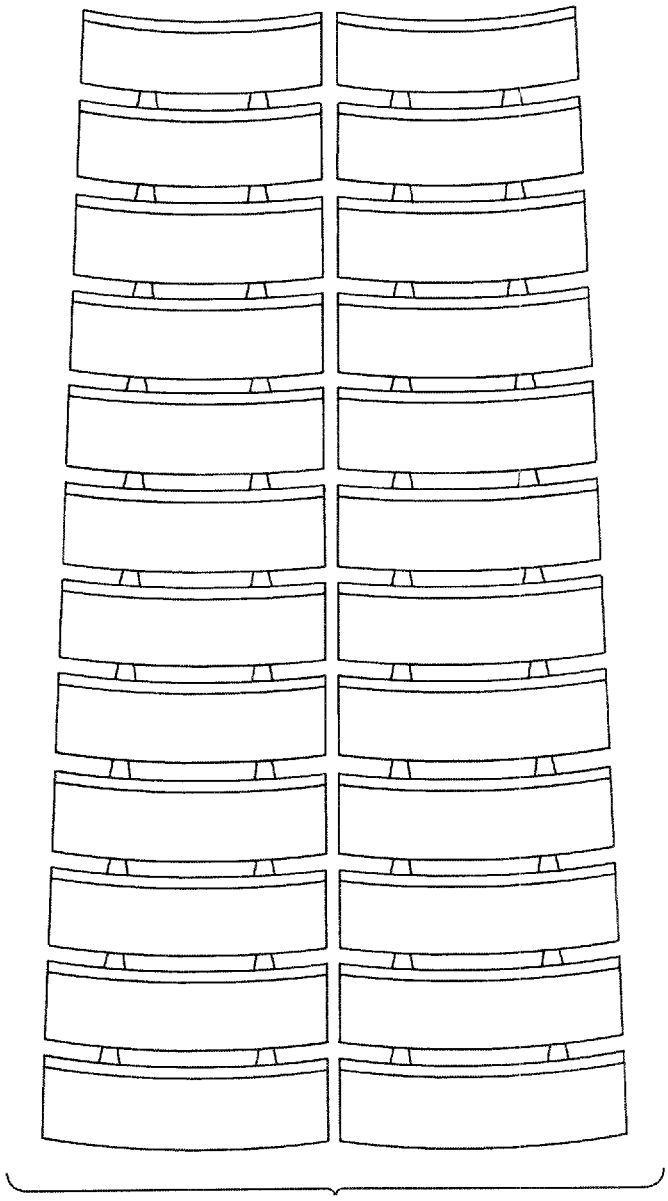
FIG. 3 is a top view of multiple plumbing fixtures according to the present invention.

Referring to FIG. 3, a view of the invention as molded in pairs is shown. It is anticipated, that the shim may use living hinges to connect its detachable pieces together. In this manner, shims may be created through simple molding methods and may comprise a single unitary piece of material.

Figure 4A:
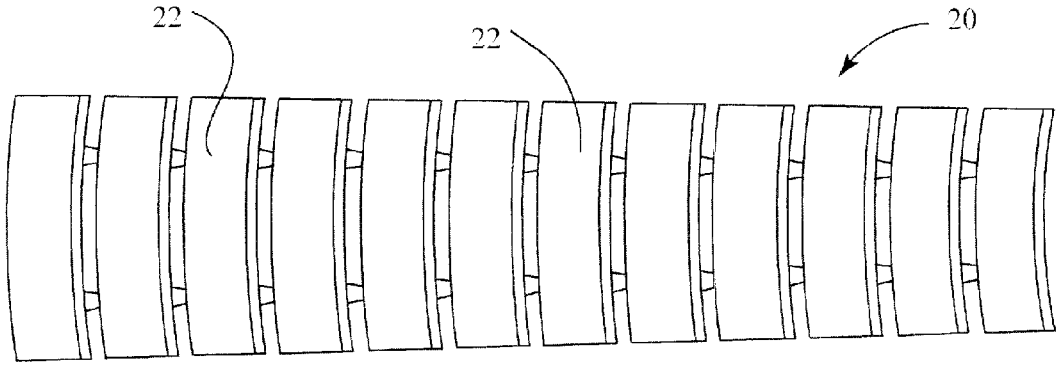
FIG. 4A is a top view of the plumbing fixture shim of the present invention.
Figure 4B:
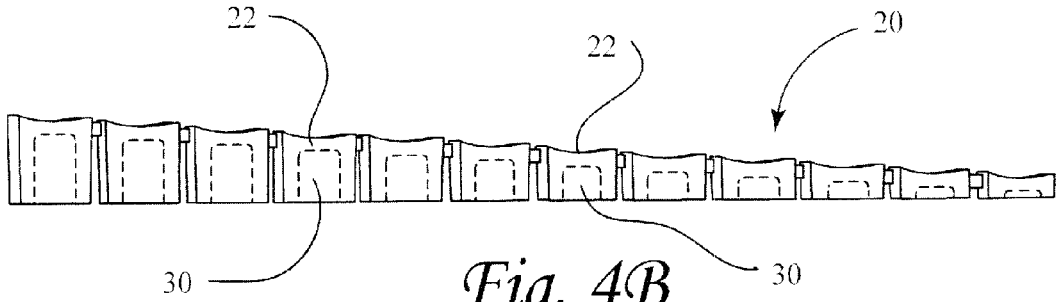
FIG. 4B is a side view of the plumbing fixture shim of the present invention.
Figure 4C:
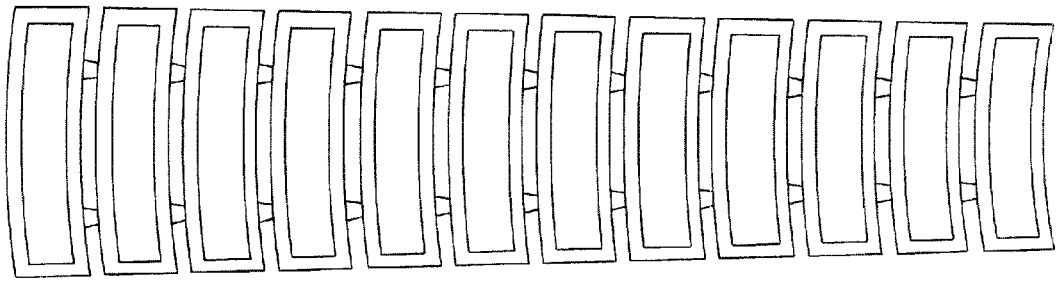
FIG. 4C is a bottom view of the plumbing fixture shim of the present invention.

Referring to FIGS. 4A, 4B and 4C, top, side and bottom views, respectively, are shown. In views 4B and 4C, it can be seen that each segment 22 also comprises a hollow portion 28, the segment being open at the bottom. The hollow portion is designed to save on material, while still allowing a segment 22 to effectively support a plumbing fixture. Also shown in FIGS. 4A, 4B and 4C are the overall dimensions of the shim 20. The shim 20 is preferably 1.248 inches in width at its thickest extreme and 0.998 inches in width at its thinnest extreme. The shim 20 ranges from a thickness of 0.401 inches to 0.089 inches from end to end, and is preferably 4.793 inches long. In another preferred embodiment, the individual segments 22 are 0.342 inches wide along the length of the shim 20.

The segments preferably vary in size at 1/32 inch increments from segment to segment. In another embodiment, the segments 20 range from 1/16 to 13/32 inches thick. In one preferred embodiment, the segments are: 0.062, 0.090, 0.119, 0.147, 0.176, 0.204, 0.233, 0.261, 0.290, 0.318, 0.346, and 0.375 inches, respectively. In one embodiment, the shims comprise hollow spaces 30, to reduce material costs associated with manufacturing.

Since the shim may be manufactured using molding techniques, it is anticipated that the shim will be made of plastic or similar materials. In one preferred embodiment, the plastic material may comprise high-impact polystyrene.

In order to use the shim of the present invention, a plumbing fixture needing shimming and the location of the area to be shimmed identified. The shim is then inserted, thin end first into the space between the fixture and its installation surface, until the bottom of the fixture is supported on one of the shim segments, with the bottom of the fixture disposed in the segment channel. Once the weight of the fixture is borne by a segment, the remaining segments extending out from the fixture may be removed by a pulling or twisting action. Because the segments are connected with tabs designed to separate on the side of a segment facing a thicker segment, when the remaining segments are removed, a smooth surface remains which may be covered over with grout or caulk.

Although the present invention has been described in considerable detail with reference to certain preferred versions thereof, other versions are possible. For instance the escutcheon and base assembly may be used for outdoor fixtures, and other areas where a tool-less quick disassembly is desirable. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A shim for leveling and supporting plumbing fixtures against an installation surface, comprising:

a series of individually detachable connected members, said series comprising a flat bottom and a generally sloping top;

said connected members being arc shaped along their length and arranged in a nested configuration;

said connected members each comprising a support having a concave portion adapted to engage the bottom of a plumbing fixture;

said connected members connected by a detachable portion adapted to break away from said support whereby said detachable portion separates from said connected member under said plumbing fixture; and wherein said connected members comprise four sides and a top, and further comprise a concave hollow bottom.

2. The shim of claim 1 wherein said arc shape comprises a radius of substantially 4.25 inches.

3. The shim of claim 1 further comprising a channel in the top the channel comprising an arc, the radius of which is substantially 0.75 inches.

4. A shim for leveling and supporting plumbing fixtures against an installation surface, comprising:

a series of nested individually detachable connected arced members, said series comprising a flat bottom and a stepped sloping top;

said connected arced members each having a top surface comprising a concave support adapted to engage the bottom surface of a plumbing fixture; and said connected arced members connected by detachable tabs, each of said tabs adapted to break away from a smaller of the two arced members to which it is connected, while remaining connected to a larger of the two arced members to which it is connected.

5. A method of shimming a plumbing fixture, such as a toilet, sink or tub, comprising the steps of:

placing a fixture on an installation surface so as to locate areas needing shimming;

obtaining a shim, comprising a series of connected members, each member comprising an arc shape and further comprising a top surface with a channel disposed therein, and wherein said connecting members are detachable in a manner leaving a clean edge along the portion of the connected member facing outward from the fixture;

placing the shim under the fixture so that the bottom of the fixture comes to rest in the channel of one connected member, and so that the connected member supports and stabilizes the fixture; and separating the connected members extending from the fixture from the connected member under the fixture by forcing the connected members apart, wherein connecting material between the connected members separates cleanly from the connected member under the fixture.

* * * * *